US010035348B2

(12) United States Patent
Moya Rojo et al.

(10) Patent No.: US 10,035,348 B2
(45) Date of Patent: Jul. 31, 2018

(54) SPITTOON BEAM SYSTEM AND PRINTER WITH A SPITTOON BEAM SYSTEM

(71) Applicant: HEWLETT-PACKARD DEVELOPMENT COMPANY, L.P., Houston, TX (US)

(72) Inventors: Oscar Moya Rojo, Barcelona (ES); Rafael Ulacia Portoles, Barcelona (ES); Joaquim Brugue Garvi, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/313,935

(22) PCT Filed: Jun. 3, 2014

(86) PCT No.: PCT/EP2014/061458

§ 371 (c)(1),
(2) Date: Nov. 23, 2016

(87) PCT Pub. No.: WO2015/185107

PCT Pub. Date: Dec. 10, 2015

(65) Prior Publication Data

US 2017/0190181 A1 Jul. 6, 2017

(51) Int. Cl.
*B41J 2/16* (2006.01)
*B41J 2/165* (2006.01)

(52) U.S. Cl.
CPC ..... *B41J 2/165* (2013.01); *B41J 2/16* (2013.01); *B41J 2002/16502* (2013.01)

(58) Field of Classification Search
CPC ..... B41J 2/16505; B41J 2002/16502; B41J 2/16511; B41J 2/16547; B41J 2/16523
See application file for complete search history.

(56) References Cited

U.S. PATENT DOCUMENTS 7,311,379 B2 12/2007 Mitsuzawa
7,766,449 B2 * 8/2010 Watanabe ..... B41J 2/16538 347/29
7,866,810 B2 1/2011 Campion et al.
8,134,750 B2 3/2012 Chandu et al.
8,147,031 B2 * 4/2012 Shinoda ..... B41J 2/16585 347/22

(Continued)

FOREIGN PATENT DOCUMENTS

JP 2000343716 12/2000
WO WO-2009089567 7/2009

*Primary Examiner* — Patrick King
(74) *Attorney, Agent, or Firm* — HP Inc. Patent Department

(57) ABSTRACT

A spittoon beam system and a printer that includes a spittoon beam system. The system has a spittoon beam spanning and movably mounted to spaced spaced parallel tracks. The spittoon beam is driven along the tracks by a first motor and a second motor coupled to respective ends of the spittoon beam. A first motor driver is coupled to the first motor and a second motor driver coupled the second motor. The system is configured so that the first motor driver controls an output shaft speed of the first motor independently of the second motor driver, and the second motor driver controls an output shaft speed of the second motor independently of the first motor driver.

15 Claims, 6 Drawing Sheets

100

(56) References Cited

U.S. PATENT DOCUMENTS

| | | | | |
|---|---|---|---|---|
| 9,227,412 | B1 * | 1/2016 | Liu | B41J 2/16544 |
| 2004/0257397 | A1 | 12/2004 | Gomez et al. | |
| 2006/0119651 | A1 | 6/2006 | Berry et al. | |
| 2006/0152546 | A1 | 7/2006 | Udagawa | |
| 2007/0059077 | A1 | 3/2007 | Silverbrook et al. | |
| 2007/0091139 | A1 * | 4/2007 | Takatsuka | B41J 2/16511 347/29 |
| 2008/0309702 | A1 * | 12/2008 | Takahashi | B41J 2/16511 347/19 |
| 2009/0002412 | A1 * | 1/2009 | Kawakami | B41J 2/155 347/8 |
| 2010/0289852 | A1 | 11/2010 | Woolfe et al. | |
| 2011/0157270 | A1 | 6/2011 | Kawakami | |
| 2011/0199429 | A1 | 8/2011 | Hayashi | |
| 2011/0221821 | A1 | 9/2011 | Asano | |
| 2013/0307901 | A1 * | 11/2013 | Takahashi | B41J 2/16547 347/33 |
| 2014/0125749 | A1 * | 5/2014 | Spence | B41J 2/215 347/104 |
| 2014/0292913 | A1 * | 10/2014 | Higuchi | B41J 2/16526 347/31 |

* cited by examiner

SPITTOON BEAM SYSTEM AND PRINTER WITH A SPITTOON BEAM SYSTEM

BACKGROUND

Printing often use print cartridges, sometimes referred to as "pens" which may shoot drops of printing fluid referred to generally herein as printing fluid, onto print media, such as paper. Each print cartridge may have a print head (print head die) with very small nozzles through which the ink drops are shot using various technologies, such as thermal or piezo-electric inkjet technology. Between incremental advancing steps of the media through a printzone, the printhead may be propelled back and forth across the media while selectively firing drops of ink on the media to form a desired image. The printhead nozzles may be arranged in linear arrays, oriented perpendicular to a scanning axis of the printheads.

To maintain printhead health, the printheads may be serviced in a service station area of the printing mechanism wherein the servicing routine may include purging ink blockages from the nozzles into a spittoon during an operation known as "spitting." However, for instance, when considering Page Wide Array (PWA) printers it not possible to move the printheads to a service station and so the service station has to move to the printheads.

DETAILED DESCRIPTION

Figure 1:
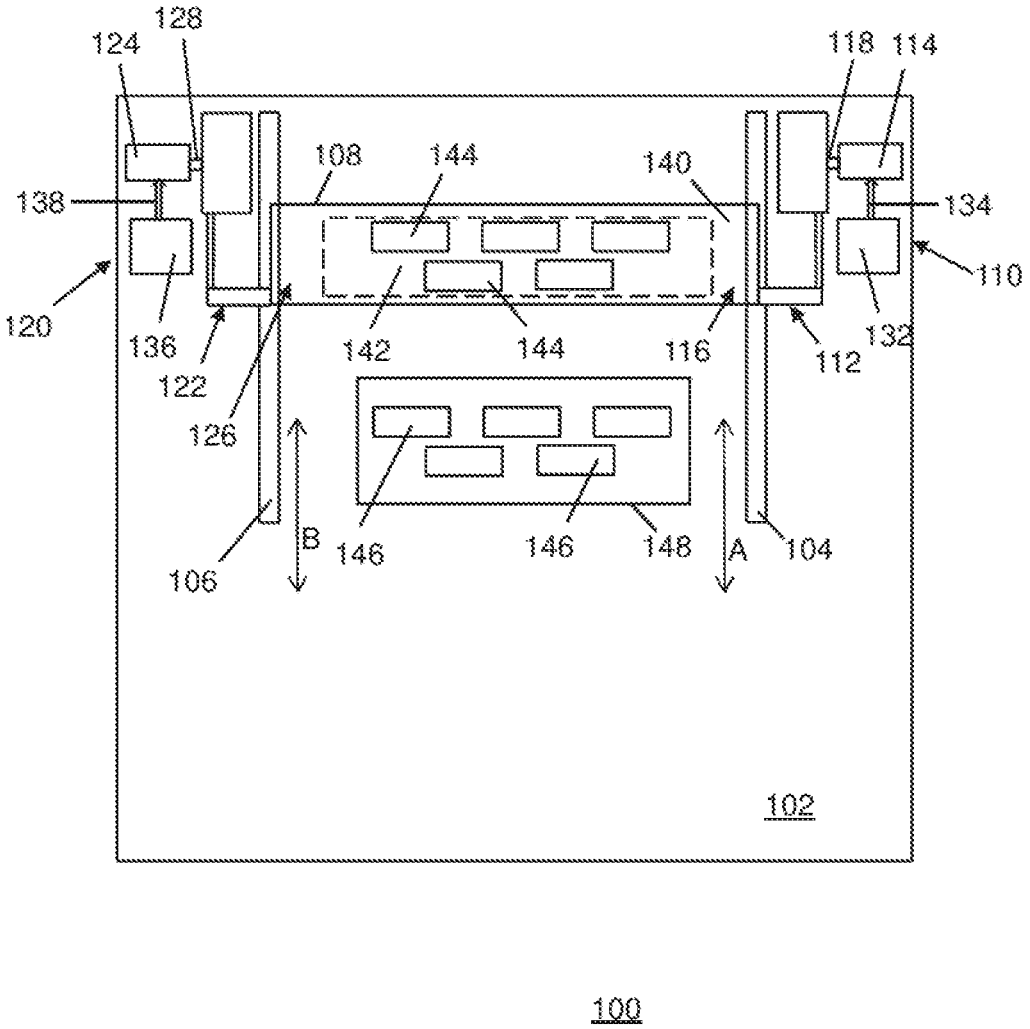
FIG. 1 is schematic diagram of an example of a spittoon beam system.

The detailed description set forth below in connection with the appended drawings is intended to provide examples of a spittoon beam system and printer. It is to be understood that the same or equivalent functions may be accomplished by different examples. In the drawings, like numerals are used to indicate like elements throughout. Furthermore, terms "comprises," "comprising," or any other variation thereof, are intended to cover a non-exclusive inclusion and do not necessarily include only those elements listed but may include other elements not expressly listed.

In one example there is provided a spittoon beam system comprising a mount and two spaced parallel tracks fixed to the mount. There is a spittoon beam spanning and movably mounted to the spaced parallel tracks. A first drive system includes a first coupling mechanism and a first motor. The first coupling mechanism is attached to a first end region of the beam and couples an output shaft of the first motor to the first end region to provide relative movement between the output shaft of the first motor and the beam. There is also a second drive system including a second coupling mechanism and a second motor. The second coupling mechanism is attached to a second end region of the beam and couples an output shaft of the second motor to the second end region to provide relative movement between the output shaft of the second motor and the beam. There is also a first motor driver coupled to the first motor and a second motor driver coupled the second motor. The system is configured so that the first motor driver controls an output shaft speed of the first motor independently of the second motor driver, and the second motor driver controls an output shaft speed of the second motor independently of the first motor driver.

In another example there is provided a printer comprising the above spittoon beam system example, wherein the spittoon beam has spaced apertures that are located to align with respective print head dies when the spittoon beam is moved from a stored position to a print head maintenance position.

Referring now to FIG. 1 there is illustrated a schematic diagram of an example of a spittoon beam system 100 comprising a mount 102. The mount 102 may be a single structure or a plurality of interconnected components such as supports mounted to a base that may form housing for the spittoon beam system 100.

In this example there are two spaced parallel tracks 104, 106 fixed to the mount 102; the tracks 104, 106 may be fixed to the mount 102 by any suitable known attachment devices such as bolts, screws, pins or snap fitment assemblies.

There is a spittoon beam 108 spanning and movably mounted to the spaced parallel tracks 104, 106. The spittoon beam 103 may have low friction surfaces for allowing a sliding movement along the spaced parallel tracks 104, 106. Another option is to provide rollers to allow the spittoon beam 108 to move along the spaced parallel tracks 104, 106.

In this example, there is a first drive system 110 including a first coupling mechanism 112 and a first motor 114. The first coupling mechanism 112 is attached to a first end region 116 of the spittoon beam 108. The first coupling mechanism 112 couples an output shaft 118 of the first motor 114 to the first end region 116. This coupling, in use, provides relative movement between the first end region 116 and the output shaft 118 to move the spittoon beam 108 along track 104 as indicated by arrowed line A.

As illustrated, this example of the spittoon beam system 100 comprises a second drive system 120 including a second coupling mechanism 122 and a second motor 124. The second coupling mechanism 122 is attached to a second end region 126 of the spittoon beam 108. The second coupling mechanism 122 couples an output shaft 128 of the second motor 124 to the second end region 126. This coupling, in use, provide relative movement between the second end region 126 and the output shaft 12B to move the spittoon beam 108 along track 106 as indicated by arrowed line B.

This example of the spittoon beam system 100 includes a first motor driver 132 coupled, by wires 134, to the first motor 114 and a second motor driver 136 coupled, by wires 138, to the second motor 124. In use, the first motor driver 132 and a second motor driver 136 operate independently of each other and supply power to their respective motors 114, 124. Consequently, the spittoon beam system 100 is configured so that the first motor driver 132 controls an output shaft speed of the first motor 114 independently of the second motor driver 136. Similarly, the spittoon beam system 100 is configured so that the second motor driver 136 controls an output shaft speed of the second motor 124 independently of the first motor driver 132.

In this example, the spittoon beam 108 may have an upper wall 140 covering a spittoon chamber 142 (shown in phantom) and a plurality of spaced apertures 144 in the upper wall 140 that provides external access to the spittoon chamber 142. In another example the upper wall 140 may cover a plurality of separate spittoon chambers with each of the spaced apertures 144 providing external access to one of the spittoon chambers.

The first motor 114 and second motor 124 may be servo motors and the spittoon beam system 100 may be part of a printer. When the spittoon beam system 100 is part of a printer, typically a PWA printer as illustrated, the spaced apertures 144 may be located to align with respective print head dies 146 when the spittoon beam 108 is moved from the illustrated stored position to a print head maintenance position 148.

Figure 2:
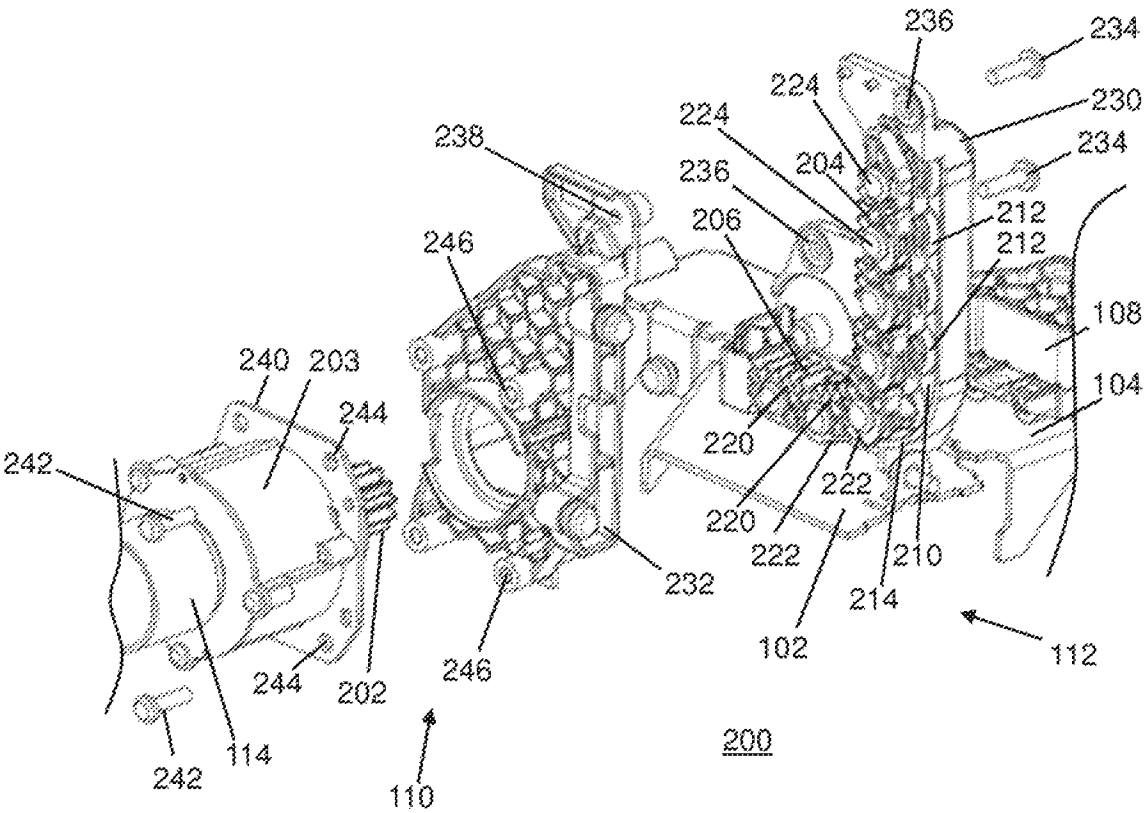
FIG. 2 is a perspective view of an example of part of a partially dis-assembled first side of the spittoon beam system of FIG. 1, when in a retracted or stored position.

Referring to FIG. 2 there is illustrated a perspective view of an example of part of a partially dis-assembled first side 200, of the spittoon beam system 100, when in a retracted or stored position. This example shows, amongst others, the first drive system 110, the first coupling mechanism 112 and the spittoon beam 108. In this example, the first coupling mechanism 112 of the first drive system 110 includes a first drive cog 202 coupled to the output shaft 118 of the first motor 114. In this example, the first drive cog 202 is part of a first speed reduction gearbox 203 at the output shaft 118 of the first motor 114 when assembled, the first coupling mechanism 112 includes a first chain 204 with teeth 206 that operatively engage the first drive cog 202.

In this example, the first coupling mechanism 112 includes a first chain storage channel 210 and the first chain 204 includes storage channel guiding rollers 212 that engage a track 214 of the first chain storage channel 210 when the first chain 204 is in the illustrated retracted or stored position. The first chain 204 may have adjacent links 220 with opposing faces 222 that engage, when the first chain 204 is in a horizontal orientation, so that the first chain 204 forms a weight bearing beam when protruding horizontally from first chain storage channel 210. The adjacent links 220 are pivotally coupled together by pins 224 that also provide pivotal mounting of the rollers 212 to the first chain 204.

The first coupling mechanism 112, in this example, includes two plates 230, 232 that are fixed together by screws 234 protruding through respective apertures 236 in plate 230 and engaging aligned respective threaded apertures 238 of the plate 232 to form the first chain storage channel 210. In this example the first speed reduction gearbox 203 has an attached apertured flange 240 mountable to the plate 232 by screws 242 protruding through respective apertures 244 in the flange 240 and engaging aligned threaded apertures 246 of the plate 232.

Figure 3:
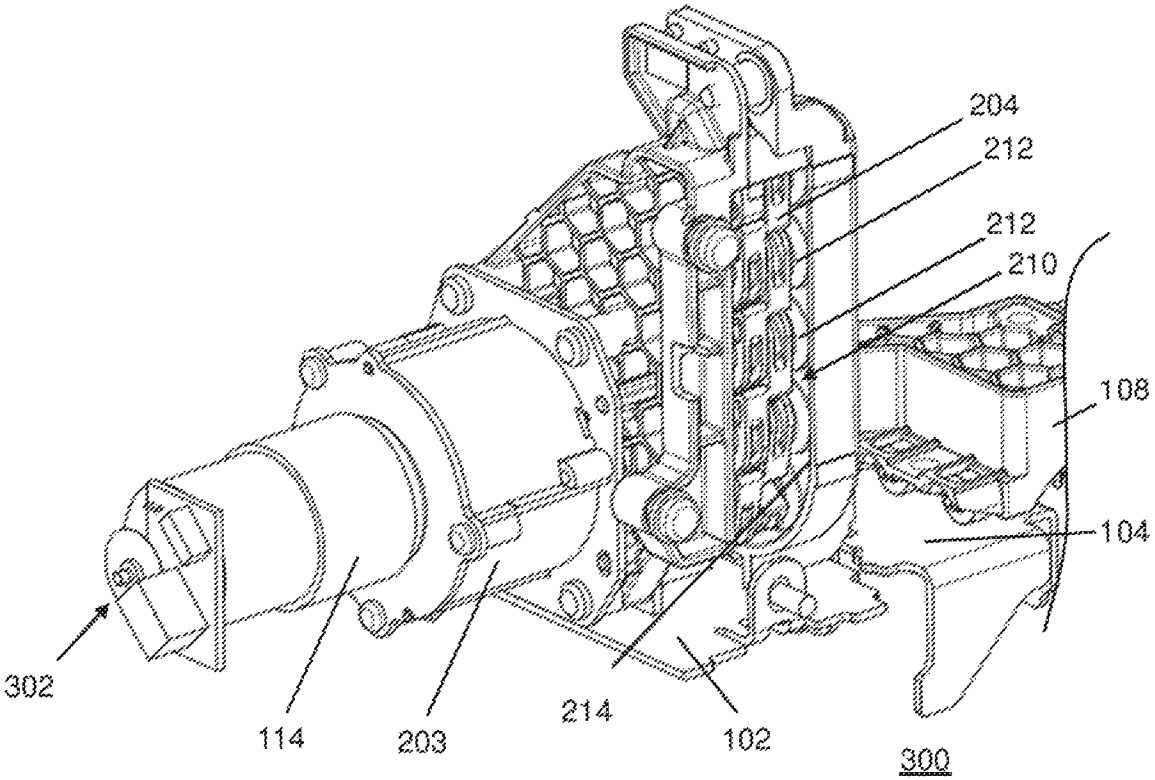
FIG. 3 is a perspective view of an example an assembled first side of the spittoon beam system of FIG. 1, when in the retracted or stored position.

Referring to FIG. 3 there is illustrated a perspective view of an example an assembled first side 300 of the spittoon beam system 100 when in the retracted or stored position. This illustration is the assembled version of the exploded view of FIG. 2. As shown, the storage channel guiding rollers 212 engage the track 214 of the first chain storage channel 210 when the first chain 204 is in the illustrated retracted or stored position. Since the first motor 114 may be a servo motor there is servo motor position sensor assembly 302 coupled to the first motor 114.

Figure 4:
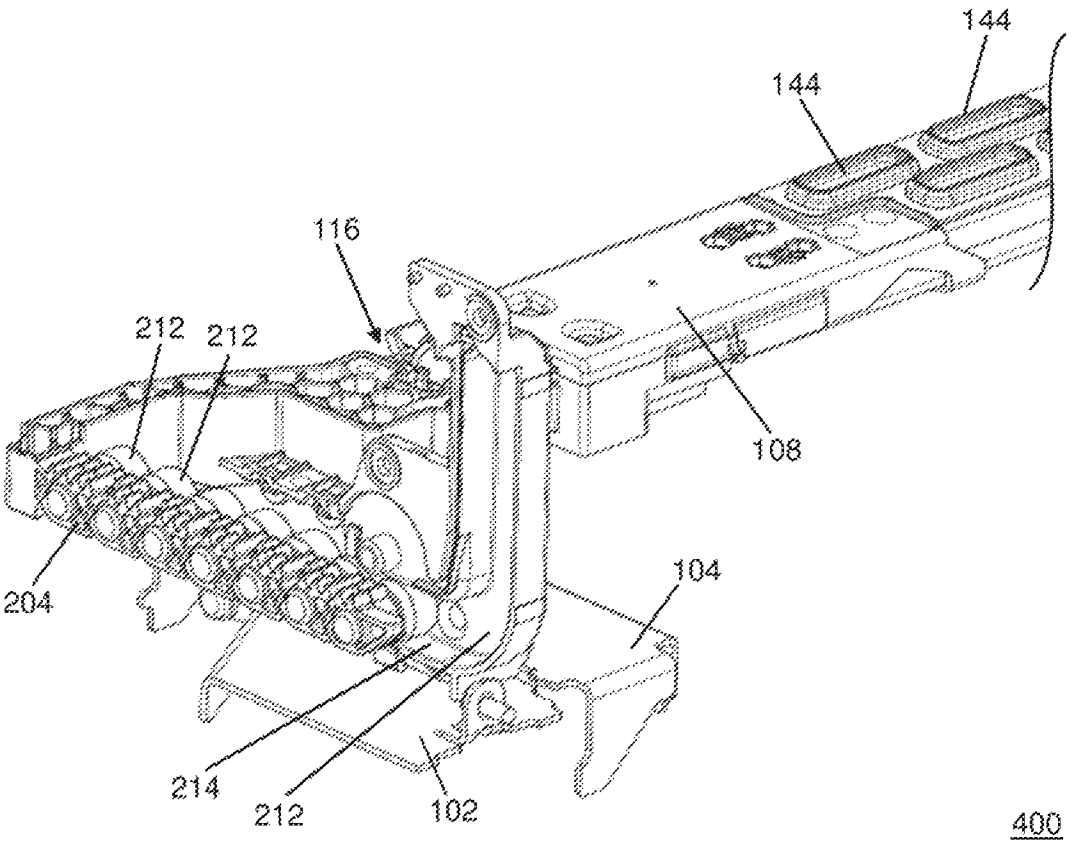
FIG. 4 is a perspective view of as example of part of an extended first side, of the spittoon beam system of FIG. 1.

Referring to FIG. 4 there is illustrated a perspective view of an example of part of an extended first side 400, of the spittoon beam system 100. In this illustration the plate 232 and first motor 114 have been removed to more clearly illustrate the first chain 204.

Figure 5:
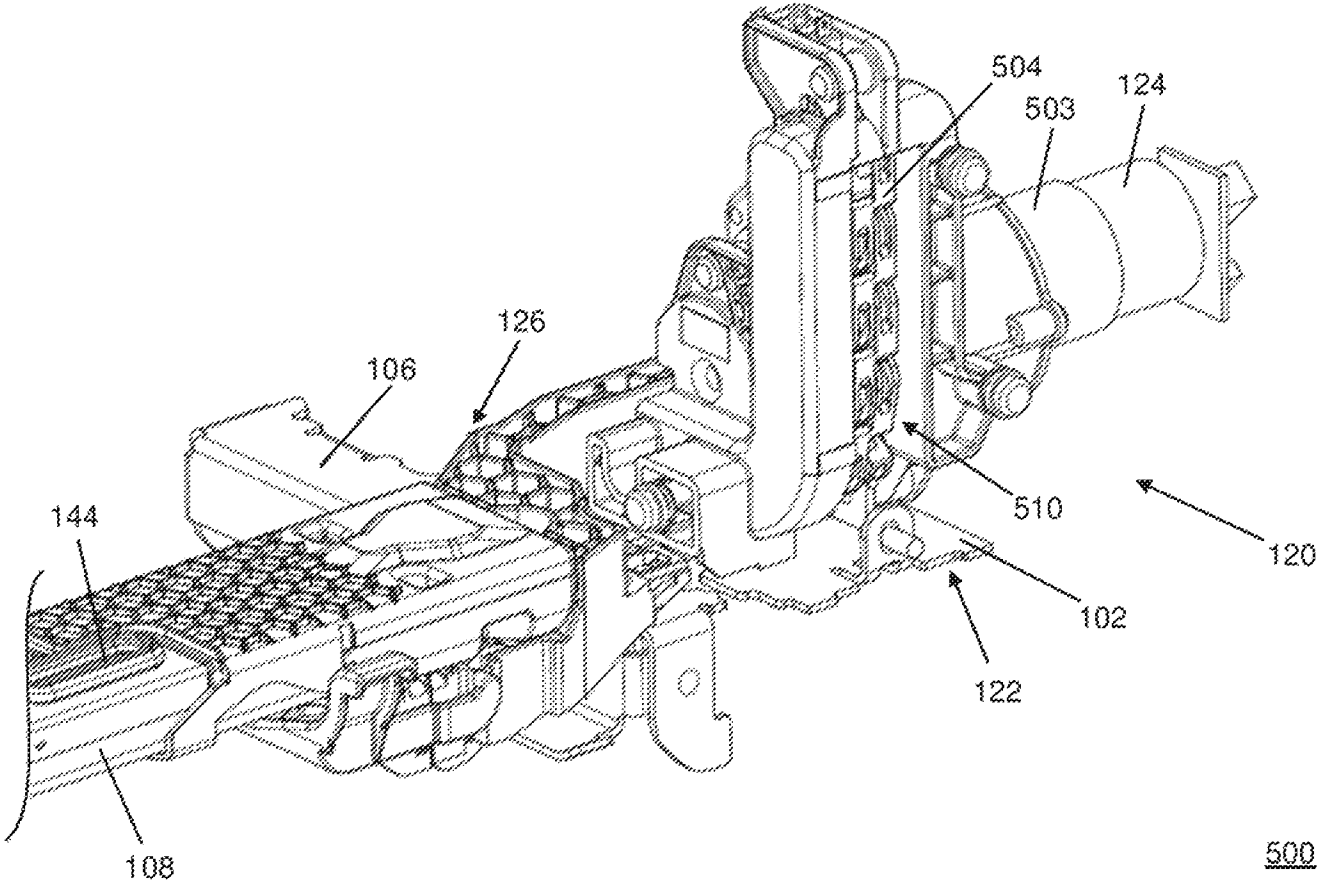
FIG. 5 is a perspective view of an example an assembled retracted second side of the spittoon beam system of FIG. 1.

Referring to FIG. 5 there is illustrated a perspective view of an example an assembled retracted second side 500 of the spittoon beam system 100. In this example, the coupling mechanism 122 of the second drive system 120 includes a second drive cog (not shown) coupled to the output shaft 128 of the second motor 124. Also, in this example, the second drive cog is part of a second speed reduction gearbox 503 at the output shaft 128 of the second motor 124 which is typically a servo motor. Furthermore, the second coupling mechanism 122 includes a second chain 504 and a second chain storage channel 510.

Figure 6:
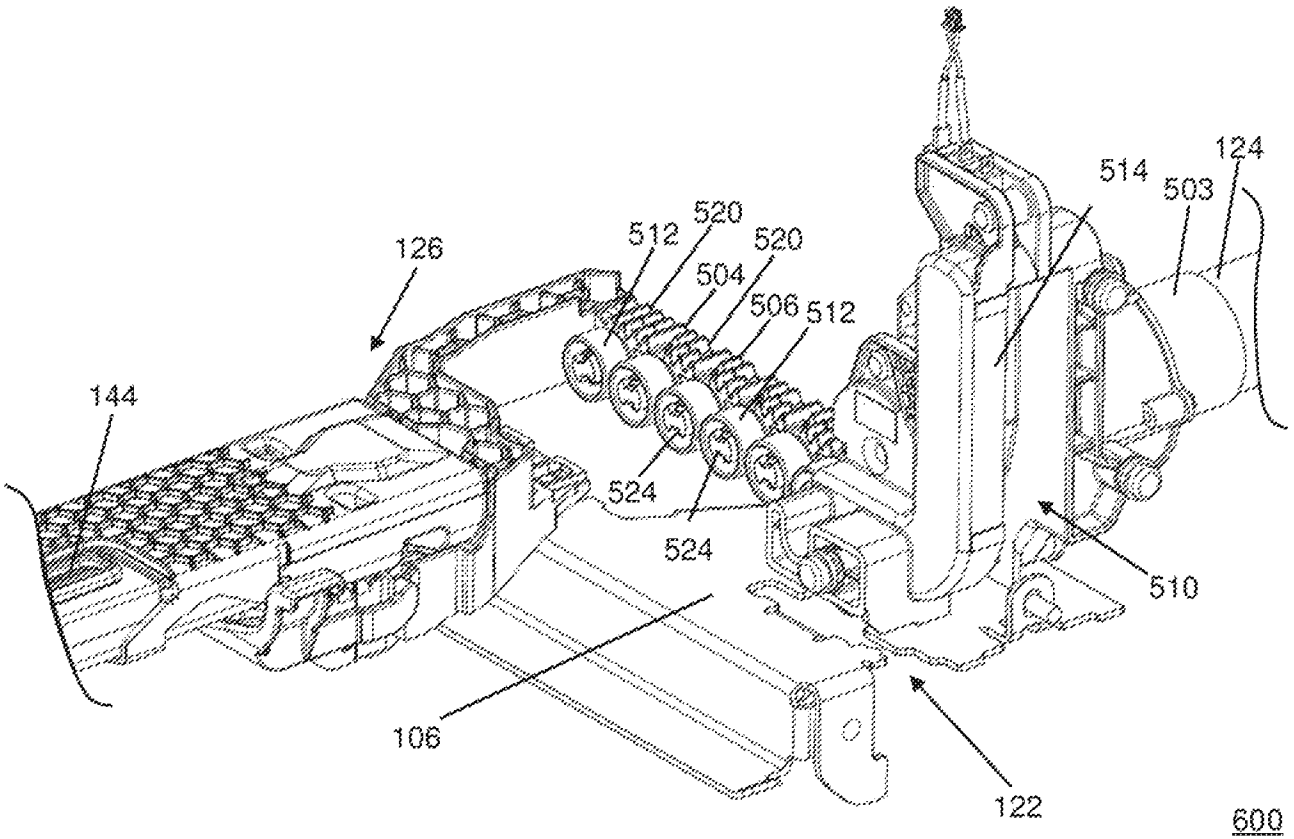
FIG. 6 is a perspective view of an example an assembled extended second side of the spittoon beam system of FIG. 1.

Referring to FIG. 6 there is illustrated a perspective view of an example an assembled extended second side 600 of the spittoon beam system 100. In this example, the second chain 504 includes storage channel guiding rollers 512 that engage a track 514 of the second chain storage channel 510 when the second chain 504 is in the retracted or stored position of FIG. 5. The second chain 504 may have adjacent links 520 with opposing faces (not shown) that engage, when the second chain 504 is in the illustrated horizontal orientation, so that the second chain 504 forms a weight bearing beam when protruding horizontally from second chain storage channel 510. The adjacent links 520 are pivotally coupled together by pins 524 that also provide pivotal mounting of the rollers 512 to the second chain 504. The second chain 504 has teeth 506 that operatively engage the second drive cog.

As shown in this example, the second chain 504 is attached to the second end region 126 of the spittoon beam 108. Also, this example shows that the second chain 504 may be a non-continuous chain that is retractable into the second chain storage channel 510. Furthermore, when in the illustrated extended position, the system 100 is in the print head maintenance position 148 so that the spaced apertures 144 are located to align with respective print head dies 146. In this example, the second side of the spittoon beam system 100 is a mirror image of the first side and therefore to avoid repetition the assembly of the second side is not described in detail.

To save space, a service station area may foe replaced with the spittoon beam system with the spittoon beam which is movable along the tracks from a storage area to a service area. The service area is not reserved for servicing purposes only and thus spacing saving may result. The spittoon beam system 100 may replace the typically driven master-slave servo motors that provide synchronized relative movement to each spittoon beam system. The spittoon beam system 100 may also replace the known drive system of a single motor coupled to one spittoon beam and coupled via a drive shaft the second end of the spittoon beam.

Advantageously, the examples illustrated provide a relatively inexpensive system for driving the spittoon beam without the need for either master-slave servo motors and their associated drives. Further, the examples illustrated do not require a drive shaft that spans the spittoon beam to provide a synchronized drive mechanism at the expense of space and possible undesirable drive shaft wobble. In addition, the flexibility of the first and second drive systems 110, 120 allow for relatively simple alignment and adjustment of the orientation of the beam 108 relative to the tracks 104, 106.

The description of the examples herein has been presented for purposes of illustration and description, but is not intended to be exhaustive or limiting.

The invention claimed is:

1. A spittoon beam system comprising:

a mount;

two spaced parallel tracks fixed to the mount;

a spittoon beam spanning and movably mounted to the spaced parallel tracks;

a first drive system including a first coupling mechanism and a first motor, wherein the first coupling mechanism is attached to a first end region of the beam and couples an output shaft of the first motor to the first end region to provide relative movement therebetween;

a second drive system including a second coupling mechanism and a second motor, wherein the second coupling mechanism is attached to a second end region of the beam and couples an output shaft of the second motor to the second end region to provide relative movement therebetween; and a first motor driver coupled to the first motor and a second motor driver coupled the second motor, wherein the system is configured so that the first motor driver controls an output shaft speed of the first motor independently of the second motor driver, and the second motor driver controls an output shaft speed of the second motor independently of the first motor driver.

2. The spittoon beam system in accordance with claim 1, wherein the first motor and second motor are servo motors.

3. The spittoon beam system in accordance with claim 1, wherein the first coupling mechanism includes a first drive cog coupled to the output shaft of the first motor.

4. The spittoon beam system in accordance with claim 3, wherein the first coupling mechanism includes a first chain that engages the first drive cog.

5. The spittoon beam system in accordance with claim 4, wherein the first chain is attached to the first end region of the spittoon beam.

6. The spittoon beam system in accordance with claim 4, or claim 5, wherein the first coupling mechanism includes a first chain storage channel.

7. The spittoon beam system in accordance with claim 5, wherein the first chain is an non-continuous chain that is retractable into a first chain storage channel.

8. The spittoon beam system in accordance with claim 6, wherein the first chain includes teeth that engage teeth of the first drive cog.

9. The spittoon beam system in accordance with claim 7, wherein the first chain includes storage channel guiding rollers that engage a track of the first chain storage channel when the first chain is in a retracted position.

10. The spittoon beam system in accordance with claim 9, wherein the first chain has adjacent links with opposing faces that engage to form a weight bearing beam when protruding horizontally from the first chain storage channel.

11. The spittoon beam system in accordance with claim 1, wherein the second coupling mechanism includes a second drive cog coupled to the output shaft of the second motor.

12. The spittoon beam system in accordance with claim 11, wherein the second coupling mechanism includes a second chain that engages the second drive cog.

13. The spittoon beam system as claimed in claim 1, wherein the spittoon beam includes:

an upper wall covering a spittoon chamber; and a plurality of spaced apertures in the upper wall providing external access to the spittoon chamber.

14. The spittoon beam system as claimed in claim 1, wherein the spittoon beam includes:

an upper wall covering a plurality of spittoon chambers; and a plurality of spaced apertures in the upper wall each providing external access to one of the spittoon chambers.

15. A printer comprising the spittoon beam system as claimed in claim 13, wherein the spaced apertures are located to align with respective print head dies when the spittoon beam is moved from a stored position to a print head maintenance position.

* * * * *